US006077371A

United States Patent [19]

Lundstrom et al.

[11] Patent Number: 6,077,371

[45] Date of Patent: Jun. 20, 2000

[54] GAS GENERANTS COMPRISING TRANSITION METAL NITRITE COMPLEXES

[75] Inventors: Norman H. Lundstrom, Tacoma, Wash.; Laurence C. Begin, Warren, Mich.

[73] Assignee: Automotive Systems Laboratory, Inc., Farmington Hills, Mich.

[21] Appl. No.: 08/797,398

[22] Filed: Feb. 10, 1997

[51] Int. Cl.[7] ..... C06B 31/00; C06B 33/00

[52] U.S. Cl. ..... 149/37; 149/45; 149/61; 149/77

[58] Field of Search ..... 149/37, 45, 61, 149/77

[56] References Cited

U.S. PATENT DOCUMENTS

| | | | |
|---|---|---|---|
| 2,220,891 | 11/1940 | Cook et al. | 52/14 |
| 2,220,892 | 11/1940 | Cook et al. | 53/19 |
| 2,222,175 | 11/1940 | Hauff et al. | 52/14 |
| 3,463,684 | 8/1969 | Dehu | 149/45 |
| 3,673,015 | 6/1972 | Sollott et al. | 149/29 |
| 4,336,085 | 6/1982 | Walker et al. | 149/45 |
| 4,863,534 | 9/1989 | Forsberg | 149/61 X |
| 5,160,386 | 11/1992 | Lund et al. | 149/88 |
| 5,266,132 | 11/1993 | Danen et al. | 149/15 |
| 5,460,669 | 10/1995 | Willer et al. | 149/92 |
| 5,500,059 | 3/1996 | Lund et al. | 149/61 X |
| 5,542,704 | 8/1996 | Hamilton et al. | 280/741 |
| 5,544,687 | 8/1996 | Barnes et al. | 149/61 X |
| 5,592,812 | 1/1997 | Hinshaw et al. | 60/205 |
| 5,673,935 | 10/1997 | Hinshaw et al. | 149/45 X |
| 5,682,014 | 10/1997 | Highsmith et al. | 149/36 |
| 5,725,699 | 3/1998 | Hinshaw et al. | 149/45 X |
| 5,734,124 | 3/1998 | Bruenner et al. | 149/45 X |
| 5,735,118 | 4/1998 | Hinshaw et al. | 149/45 X |
| 5,756,929 | 5/1998 | Lundstrom et al. | 149/45 X |

FOREIGN PATENT DOCUMENTS

| | | |
|---|---|---|
| 544582 | 8/1940 | United Kingdom . |
| WO 95/04016 | 2/1995 | WIPO . |
| WO 95/19944 | 7/1995 | WIPO . |

OTHER PUBLICATIONS

International Publication No. WO 98/06486, dated Feb. 19, 1998, Inventor/Applicant Gary K. Lund, 94 pages.

*Primary Examiner*—Peter A. Nelson
*Attorney, Agent, or Firm*—Lyon, P.C.

[57] ABSTRACT

High nitrogen gas generant compositions, useful for inflating passenger restraint gas inflator bags, comprise a nitrogen rich coordination compound selected from coordination complexes comprised of anionic nitro and nitrito ligands coordinated with a transitional metal template, and nonmetallic or nonmetallic/metallic cations. The gas generant compositions generate relatively more gas and less solids, and are safer than known gas generant compositions. Certain gas generant compositions ignite at lower autoignition temperatures thereby facilitating the use of an aluminum or light weight metal pressure vessel. Other gas generants self-deflagrate eliminating the need for other constituents in the composition. Novel methods for the synthesis of nonmetal derivative coordination complexes, guanidine and hydrazine for example, are also presented.

35 Claims, No Drawings

GAS GENERANTS COMPRISING TRANSITION METAL NITRITE COMPLEXES

BACKGROUND OF THE INVENTION

The present invention relates to substantially nontoxic gas generating compositions which upon combustion, rapidly generate gases that are useful for inflating occupant safety restraints in motor vehicles and specifically, the invention relates to high nitrogen gas generants that produce combustion products having not only acceptable toxicity levels, but that also exhibit a relatively high gas volume to solid particulate ratio at acceptable flame temperatures.

Pyrotechnic gas generants incorporating an oxidizer such as potassium nitrate, potassium perchlorate, molybdenum disulfide, chromic chloride, copper oxide, or iron oxide with alkali metal and alkaline earth metal azides have been commercially successful. Sodium azide has been the most extensively used azide in solid gas generants for airbag systems as described in U.S. Pat. Nos. 2,981,616, 3,741,585, 3,865,660, 4,203,787, 4,547,235, and 4,758,287, the teachings of which are herein incorporated by reference.

However, azides are very toxic and sodium azide is a very poisonous material, both orally and dermatologically. In fact, sodium azide is shipped as a class B poison similar to other extremely toxic materials, such as sodium cyanide and strychnine. Sodium azide hydrolyzes, forming hydrazoic acid which is very poisonous and reacts with heavy metals such as copper and lead to form very sensitive covalent azides which are readily detonated by shock or impact. In addition, propellants prepared from sodium azide are not very efficient gas producers and result in gas outputs of only about 1.3 to 1.6 moles of gas per 100 grams of propellant.

The evolution from azide-based gas generants to nonazide gas generants is well-documented in the prior art. The advantages of nonazide gas generant compositions in comparison with azide gas generants have been extensively described in the patent literature, for example, U.S. Pat. Nos. 4,370,181; 4,909,549; 4,948,439; 5,084,118; 5,139,588 and 5,035,757, the discussions of which are herein incorporated by reference.

In addition to a fuel constituent, pyrotechnic gas generants contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. The solid products must be filtered and otherwise kept away from contact with the occupants of the vehicle. It is therefore highly desirable to develop compositions that produce a minimum of solid particulates while still providing adequate quantities of a nontoxic gas to inflate the safety device at a high rate. Furthermore, many known gas generants produce solids that even in low concentrations, could be hazardous. Upon combustion, the use of components containing alkali and alkaline earth metals can result in the formation of highly alkaline reaction products. Compounds such as these could potentially cause severe caustic burns if contacted with the skin or eyes of a vehicle occupant.

While known nonazide gas generants provide operable amounts of gas with a minimum of solid combustion products, in many cases, the mass of gas generant required compared to the mass of gas produced is still cause for concern. The volume of the inflator necessarily reflects the volume of gas generant required to produce the gas needed to deploy the inflator. A reduction in the volume of gas generant needed, or an increase in the moles of gas produced per gram of gas generant, would result in a desirable reduction in inflator volume thereby enhancing design flexibility.

Yet another concern with known gas generant compositions is their compatibility with different materials used to form a pressure vessel in the gas inflator. Steel canisters are commonly used as the inflator pressure vessel in a passenger-restraint system because of the relatively high strength of steel at elevated temperatures. Given the emphasis on vehicle weight reduction, it is desirable that metals such as aluminum, and smaller or lighter steel vessels be utilized in the pressure vessel.

Engineering considerations require that vehicle operator restraint systems pass a "bonfire" test, wherein the inflator system is evaluated during exposure to fire. In the past, this has only been a concern for inflator canisters made of aluminum as the current steel pressure vessels routinely pass this test. Aluminum loses strength rapidly with increasing temperature, and may not be able to withstand the combination of increased external temperatures and excessive internal temperature and pressure generated upon combustion of the gas generant. An autoignition temperature of 175° C. or less is considered sufficient for the safe use of aluminum canisters.

The inflator must be designed to maintain its structural integrity despite the high pressures produced by a rapidly burning gas generant. If the gas generant of the inflator can be made to autoignite at relatively low temperatures, for example, 150° C. to 175° C., then the pressure vessel can be made of a lightweight metal such as aluminum.

DESCRIPTION OF THE PRIOR ART

U.S. Pat. No. 5,160,386, to Lund et al, describes a gas generant having an oxidizer comprised of a polynitrito transition metal complex anion, and, a cationic component selected from the group including alkali metal and alkaline earth metal ions. Combustion products formed from these compositions are highly alkaline. When used with the appropriate fuel, the oxidizers described herein are not suitable for use with an aluminum pressure vessel due to their elevated decomposition temperatures.

U.S. Pat. No. 5,542,704, to Hamilton et al, describes the use of transition metal complexes of hydrazine such as zinc nitrate hydrazine for use in gas generant applications, wherein the oxidizer component is selected from inorganic alkali metal and inorganic alkaline earth metal nitrates and nitrites, and transition metal oxides. The cations of the coordination complexes are metallic.

Copending PCT application WO 95/19944, to Hinshaw et al, describes the use of carbon free metal cation coordination complexes with a neutral ligand containing hydrogen and nitrogen, so that when coordination complexes such as metal nitrite ammines, metal nitrate ammines, metal perchlorate ammines, and hydrazine coordination complexes are combusted, water vapor and nitrogen gas are the primary inflating products.

SUMMARY OF THE INVENTION

The aforementioned problems are solved by solid pyrotechnic gas generating compositions, certain ones of which are comprised of self deflagrating coordination complexes. Furthermore, certain coordination complexes autoignite or decompose at moderate to low temperatures that are acceptable for use in either steel or aluminum pressure vessels, and produce high concentrations of nitrogen, carbon dioxide, and water vapor. Coordination complex oxidizer compounds (hereinafter coordination complexes) disclosed in this invention are represented by the formula:

$$(NM)_u(M')_x[M''_y(NO_2)_z]$$

wherein: (1) (NM) is a nonmetal comprised of suitable combinations of elemental constituents which are capable, either alone or through oxidative reactions, of thermally decomposing into useful gaseous/vapor species such as nitrogen, carbon dioxide, and water, suggested examples of which comprise, but are not limited to, ammonia, hydrazine, hydroxylamine, guanidine, aminoguanidine, diaminoguanidine, triaminoguanidine, biguanidine, aminotriazole, guanizine, aminotetrazole, hydrazino tetrazole, 5-guanylaminotetrazole, diaminofurazan, diaminotriazole, and azoamino bis(aminofurazan) derivatives; (2) M' is an alkali metal or an alkaline earth metal; (3) M" is a metal selected from the transition metals of Groups 4–12 (new IUPAC) of the Periodic Table: (4) u=1,2,3, or 4; x=0,1,2, or 3; y=1,2, or 3; and z=4 or 6 anionic nitrito/nitro ligands as determined by the required stoichiometry of the nonmetal/metal or nonmetal cations of the coordination complex.

Coordination complexes of the present invention include ammonium cobaltinitrite (ammonium hexanitrocobaltate (III) according to IUPAC rules), and reaction products formed from mixing together solutions of sodium cobaltinitrite and ammonium chloride, or from mixing similarly soluble ammonium compounds under slightly acidic conditions. Additional oxidizer compounds include the nitrometallate reaction products formed from mixing together solutions of sodium cobaltinitrite with soluble guanidine, aminoguanidine, diaminoguanidine, triaminoguanidine, hydrazine, and hydroxylamine salts and/or compounds under varying conditions of pH. Novel methods of preparing compounds such as these are presented in Examples 26 and 27.

Although the components of the present invention have been described in their anhydrous form, it will be understood that the teachings herein encompass the hydrated forms as well.

DETAILED DESCRIPTION OF THE PREFERRED EMBODIMENTS

In accordance with the present invention, a gas generant composition comprises one or more coordination complex oxidizers which comprise a transition metal template, an anionic nitro or nitrito ligand, and a nonmetallic or combination nonmetallic/metallic cation.

The coordination complex oxidizer compounds disclosed in this invention are represented by the formula:

$$(NM)_u(M')_x[M''_y(NO_2)_z]$$

wherein: (1) (NM) is a nonmetal comprised of suitable combinations of elemental constituents which are capable, either alone or through oxidative reactions, of thermally decomposing into useful gaseous/vapor species such as nitrogen, carbon dioxide, and water, suggested examples of which comprise, but are not limited to, ammonia, hydrazine, hydroxylamine, guanidine, aminoguanidine, diaminoguanidine, triaminoguanidine, biguanidine, aminotriazole, guanizine, aminotetrazole, hydrazino tetrazole, 5-guanylaminotetrazole, diaminofurazan, diaminotriazole, and azoamino bis(aminofurazan) derivatives; (2) M' is an alkali metal or an alkaline earth metal; (3) M" is a metal selected from the transition metals of Groups 4–12 (new IUPAC) of the Periodic Table: (4) u=1,2,3, or 4; x=0,1,2, or 3; y=1,2, or 3; and z=4 or 6 anionic nitrito/nitro ligands as determined by the required stoichiometry of the nonmetal/metal or nonmetal cations of the coordination complex.

Examples of coordination complexes of the present invention include, but are not limited to, ammonium hexanitrocobaltate, hydrazinium nitrocobaltate, aminoguanidinium nitrocobaltate, methylamine hexanitrocobaltate, sodium ammonium nitrocobaltate, and sodium hydrazine hexanitrocobaltate.

In a nonmetal nitro/nitrito metallate, at least one nonmetallic cation is selected from the group including, but not limited to, ammonium, hydrazinium, guanidinium, aminoguanidinium, polyaminoguanidinium, hydroxylaminium, and aromatic and aliphatic amine ions.

A nonmetallic/metallic or multicomponent cation, sodium hydrazine for example, comprises at least one nonmetallic component selected from the group including, but not limited to, ammonium, hydrazinium, guanidinium, aminoguanidinium, polyaminoguanidinium, hydroxylaminium, amine, and ammine cations, and, at least one metallic component selected from the group consisting of alkali and alkaline earth metals.

As shown in Examples 26 and 27, nonmetal compounds such as hydrazine hydrate and aminoguanidine nitrate are combined with sodium cobaltinitrite to yield self deflagrating nitrocobaltate reaction products believed to be hydrazine cobaltinitrite and aminoguanidine cobaltinitrite, or its metal/hydrazine and metal/aminoguanidine analogs, respectively. It is believed that similar compounds such as 5-aminotetrazole cobaltinitrite, diaminoguanidine cobaltinitrite and triaminoguanidine cobaltinitrite exhibit similar properties.

Although coordination complex oxidizer compounds having a nonmetallic or nonmetallic/metallic cation, such as ammonium hexanitrocobaltate (III) and sodium hydrazine hexanitrocobaltate are preferred, metallic cation coordination complexes may also be used in conjunction with at least one nonmetallic or nonmetallic/metallic cation coordination complex.

Metal coordination complexes may be selected from a group comprising metal ammine complexes, metal hydrazine complexes, and metal polynitrito metallate complexes that are coordinated with neutral and/or anionic oxygen containing ligands including, but not limited to, nitrates, nitrites, chlorates, perchlorates, oxalates, chromates, halides, sulfates, and persulfates.

Metal ammine complexes are selected from a group including, but not limited to, hexamminechromium (III) nitrate, trinitrotriamminecobalt (III), hexammine cobalt (III) nitrate; hexammine cobalt (III) perchlorate; hexammine nickel (II) nitrate; tetramminecopper (II) nitrate, cobalt (III) dinitratobis(ethylenediamine) nitrate, cobalt (III) dinitrobis (ethylenediamine) nitrate, cobalt (III) dinitrobis (ethylenediamine) nitrite, and cobalt (III) hexahydroxylammine nitrate.

Metal hydrazine complexes are selected from the group including, but not limited to, sodium hydrazine hexanitrocobaltate, zinc nitrate hydrazine, tris-hydrazine zinc nitrate, bis-hydrazine magnesium perchlorate; bis-hydrazine magnesium nitrate; and bis-hydrazine platinum (II) nitrite.

Metal polynitrito metallate compounds contain a polynitrito/nitro transition metal anion and a metallic cation comprised of at least one metal selected from the group consisting of alkali, alkaline earth, and transition metals, and include, but are not limited to, potassium hexanitrocobaltate, sodium hexanitrocobaltate, and, barium, strontium, and magnesium cobaltinitrites and hydrates thereof. Reaction complexes such as these are preferably used in low concentrations.

A coordination complex is generally defined by what is formed when a central atom or ion, M, usually a metal, unites with one or more ligands, L, L', L", etc., to form a species of the type MLL'L". M, the ligands, and the resulting coordination complex may all bear charges. The coordination complex may be non-ionic, cationic, or anionic depending on the charges carried by the central atom and the coordinated groups. These groups are called ligands, and the total number of attachments to the central atom is called the coordination number. For example, cobalt (III) has a normal valence of three but in addition, an affinity for six groups, that is, a residual valence or coordination number of six. Other common names include complex ions (if electrically charged), Werner complexes, and coordination complexes.

To illustrate, a metal ammine complex is generally defined as a coordination complex in which the nitrogen atoms of ammonia are linked directly to the metal by coordinate covalent bonds. Coordinate covalent bonds are based on a shared pair of electrons, both of which come from a single atom or ion. Thus, in this case the coordination complex contains $NH_3$, ammonia, which is called a neutral ligand. In contrast to a neutral ligand, the coordination complexes of the present invention contain only anionic ligands of a nitro or nitrito character. Nitro is used when the metal, M, is coordinated with the nitrogen atom of the nitrite group. Nitrito is used when M is coordinated with an oxygen atom of the nitrite group.

The nonmetallic and/or nonmetallic/metallic coordination complex(es), in conjunction with any secondary metallic coordination complex(es), is employed in concentrations of 10 to 100%, and preferably 30 to 100%, by weight of the total gas generant composition.

A high-nitrogen, low impact and low friction sensitivity fuel(s) may be combined with the coordination complex. Nonazide fuels are preferably incorporated, however, high nitrogen azide or metal azido complex fuels, such as sodium azide, lithium azide, potassium azide, calcium azide, barium azide, strontium azide, and azido pentammine cobalt (III) nitrate, may also be utilized. Nonazide fuels are selected from a group comprising azoles, tetrazoles, triazoles, and triazines; nonmetal and metal derivatives of tetrazoles, triazoles, and triazines; linear and cyclic nitramines of normal or fine particle size; and derivatives of guanidine, cyanoguanidine, hydrazine, hydroxylamine, and ammonia.

Examples of guanidine derivative fuels include, but are not limited to, guanidine compounds, either separately or in combination, selected from the group comprised of cyanoguanidine, metal and nonmetal derivatives of cyanoguanidine, guanidine nitrate, aminoguanidine nitrate, diaminoguanidine nitrate, triaminoguanidine (TAG) nitrate (wetted or unwetted), guanidine perchlorate (wetted or unwetted), triaminoguanidine perchlorate (wetted or unwetted), amino-nitroguanidine (wetted or unwetted), guanidine picrate, guanidine carbonate, triaminoguanidine picrate (wetted or unwetted), nitroguanidine (wetted or unwetted), nitroaminoguanidine (wetted or unwetted), metal salts of nitroaminoguanidine, metal salts of nitroguanidine, nitroguanidine nitrate, and nitroguanidine perchlorate.

Other high nitrogen nonazides employed as fuels in the gas generant compositions of this invention, either separately or in combination with the above described guanidine compounds, include oxamide, oxalyldihydrazide, triazines such as 2,4,6-trihydrazino-s-triazine (cyanurichydrazide), 2,4,6-triamino-s-triazine (melamine), and melamine nitrate; azoles such as urazole and aminourazole; tetrazoles such as tetrazole, azotetrazole, 1H-tetrazole, 5-aminotetrazole, 5-nitrotetrazole, 5-nitroaminotetrazole, 5,5'-bitetrazole, azobitetrazole, diguanidinium-5,5'-azotetrazolate, and diammonium 5,5'-bitetrazole; triazoles such as nitrotriazole, nitroaminotriazole, 3-nitro-1,2,4-triazole-5-one; and metallic and nonmetallic salts of the foregoing tetrazoles, triazoles, and triazines including manganese 5,5'-bitetrazole and zinc-5-aminotetrazole. The high nitrogen fuel generally comprises 0–70% by weight of the total gas generant composition.

An optional oxidizer compound is selected from a group comprising alkali metal, alkaline earth metal, transitional metal, and nonmetallic nitramides, cyclic nitramines, linear nitramines, caged nitramines, nitrates, nitrites, perchlorates, chlorates, chlorites, chromates, oxalates, halides, sulfates, sulfides, persulfates, peroxides, oxides, and combinations thereof. These include, for example, phase stabilized ammonium nitrate, ammonium nitrate, ammonium perchlorate, sodium nitrate, potassium nitrate, strontium nitrate, copper oxide, molybdenum disulfide, nitroguanidine, amino-nitroguanidine, ammonium dinitramide, cyclotrimethylene trinitramine (RDX), and cyclotetramethylene tetranitramine (HMX). The oxidizer generally comprises 0–50% by weight of the total gas generant composition.

From a practical standpoint, the compositions of the present invention may include some of the additives heretofore used with gas generant compositions such as slag formers, compounding aids, ignition aids, ballistic modifiers, coolants, and NOX and CO scavenging agents.

Ballistic modifiers influence the temperature sensitivity and rate at which the gas generant or propellant burns. The ballistic modifier(s) is selected from a group comprising alkali metal, alkaline earth metal, transitional metal, organometallic, and/or ammonium, guanidine, and TAG salts of cyanoguanidine; alkali, alkaline earth, and transition metal oxides, sulfides, halides, chelates, metallocenes, ferrocenes, chromates, dichromates, trichromates, and chromites; and/or alkali metal, alkaline earth metal, guanidine, and triaminoguanidine borohydride salts; elemental sulfur; antimony trisulfide; and/or transition metal salts of acetylacetone; either separately or in combinations thereof. Ballistic modifiers are employed in concentrations from about 0 to 25% by weight of the total gas generant composition.

The addition of a catalyst aids in reducing the formation of toxic carbon monoxide, nitrogen oxides, and other toxic species. A catalyst may be selected from a group comprising triazolates and/or tetrazolates; alkali, alkaline earth, and transition metal salts of tetrazoles, bitetrazoles, and triazoles; transition metal oxides; guanidine nitrate; nitroguanidine; aliphatic amines and aromatic amines; and mixtures thereof. A catalyst is employed in concentrations of 0 to 20% by weight of the total gas generant composition.

Even though a very low concentration of solid combustion products are formed when the pyrotechnic gas generant compositions of the present invention are ignited, the formation of solid klinkers or slags is desirable in order to prevent unwanted solid decomposition products from passing through or plugging up the filter screens of the inflator. Suitable slag formers and coolants include lime, borosilicates, vycor glasses, bentonite clay, silica, alumina, silicates, aluminates, transition metal oxides, and mixtures thereof. A slag former is employed in concentrations of 0 to 10% by weight of the total gas generant composition.

An ignition aid controls the temperature of ignition, and is selected from the group comprising finely divided elemental sulfur, boron, carbon black, and/or magnesium, aluminum, titanium, zirconium, or hafnium metal powders, and/or transition metal hydrides, and/or transition metal sulfides, and the hydrazine salt of 3-nitro-1,2,4-triazole-5-one, in combination or separately. An ignition aid is employed in concentrations of 0 to 20% by weight of the total gas generant composition.

Processing aids are utilized to facilitate the compounding of homogeneous mixtures. Suitable processing aids include alkali, alkaline earth, and transition metal stearates; aqueous and/or nonaqueous solvents; molybdenum disulfide; graphite; boron nitride; polyethylene glycols; polypropylene carbonates; polyacetals; polyvinyl acetate; fluoropolymer waxes commercially available under the trade name "Teflon" or "Viton", and silicone waxes. The processing aid is employed in concentrations of 0 to 15% by weight of the total gas generant composition.

The various components described hereinabove for use with the coordination complexes of the present invention have been used in other known gas generant compositions. References involving nonazide gas generant compositions describing various additives useful in the present invention include U.S. Pat. Nos. 5,035,757; 5,084,118; 5,139,588; 4,948,439; 4,909,549; and 4,370,181, the teachings of which are herein incorporated by reference. As taught in that art and as will be apparent to those skilled in the art, it is possible to combine the functions of two or more additives into a single composition. For example, an oxidizer containing an alkaline earth metal, such as strontium, may also function as a slag former, a ballistic modifier ignition aid, and a processing aid.

In accordance with the present invention, preparation of the nonmetal and nonmetal/metal coordination complexes described above is taught in Examples 1–27. Generally speaking, Examples 26 and 27 provide a blueprint for the synthesis of any nonmetal cation coordination complex. As shown in Example 26, for example, a nitrated salt containing the desired nonmetal cation may be combined with sodium cobaltinitrite to yield the desired reaction products. Example 27, for example, provides a hydrated nonmetal cation, hydrazine hydrate, and combines it with sodium cobaltinitrite to yield the desired reaction products.

Many of the nonmetal cations are contained in commercially available salts or other compounds. However, they may also be directly prepared as disclosed by Robert M. Herbst and James A. Garrison, *J.O.C.,* Volume 18, pages 941–945, (1953), the teachings of which are herein incorporated by reference. The nitration of 5-aminotetrazole is taught therein and serves as a general blueprint for the nitration of any desired nonmetal cation. Combining the nitrate salt of the nonmetal cation with sodium cobaltinitrite will then yield the desired reaction products as taught in the Examples.

Preparation of the nonmetal/metal nitro/nitrito metallates is described by K. A. Hofmann and K. Buchner, *Ber.,* Volume 41, pages 3085–90, (1908) the teachings of which are herein incorporated by reference. The method given may be used as a general blueprint for the synthesis of any desired nonmetal/metal cation nitro/nitrito coordination complex. Again, commercially available reagents or those readily synthesized by one skilled in the art may be used to obtain the desired reaction products.

Preparation techniques for the nonmetal and nonmetal/metal coordination complexes are also taught in *Mellors' Comprehensive Treatise on Inorganic and Theoretical Chemistry,* Vol. VIII, (1928), pages 470–529, and, in a later addendum of Vol. VIII, *Supplement II, Part II,* (1967), pages 86–94, both of which were published by Longmans, Green, and Company, the teachings of which are herein incorporated by reference.

Furazan compounds and oxidation products thereof are disclosed in *J.O.C. U.S.S.R.* 756 (1981), the teachings of which are herein incorporated by reference.

The preparation of nonmetal and nonmetal/metal nitrometallates is also taught by Cunningham and Perkin, *J. Chem. Soc.,* volume 95, page 1562, (1909); by Wilkinson et al, *Comprehensive Coordination Chemistry,* Pergamon Press, (1987); and by Hitchman and Rowbottom, *Coordination Chemistry Review,* volume 42, pages 55–132, (1982). Each teaching is herein incorporated by reference.

The preparation of nonmetal/metal nitrometallates is yet further taught by Adolfo Ferrari and E. Mario Nardelli, *Gazzetta Chimica Italiana,* volume 77, pages 422–26, (1947), the teachings of which are herein incorporated by reference.

Preparation of the metal ammine and metal hydrazine coordination complexes of the present invention are described in copending application WO 95/19944, PCT Application No. PCT/US95/00029. Preparation of the metal polynitrito metallates is taught in U.S. Pat. No. 5,160,386. These teachings are herein incorporated by reference.

The manner and order in which the components of the gas generant compositions of the present invention are combined and compounded is not critical so long as the proper particle size of ingredients are selected to ensure the desired mixture is obtained. The compounding is performed by one skilled in the art, under proper safety procedures for the preparation of energetic materials, and under conditions which will not cause undue hazards in processing nor decomposition of the components employed. For example, the materials may be wet blended, or dry blended and attrited in a ball mill or Red Devil type paint shaker and then pelletized by compression molding. The materials may also be ground separately or together in a fluid energy mill, sweco vibroenergy mill or bantam micropulverizer and then blended or further blended in a v-blender prior to compaction.

Compositions having components more sensitive to friction, impact, and electrostatic discharge should be wet ground separately followed by drying. The resulting fine powder of each of the components may then be wet blended by tumbling with ceramic cylinders in a ball mill jar, for example, and then dried. Less sensitive components may be dry ground and dry blended at the same time.

When formulating a composition, the ratio of oxidizer to fuel, wherein the metal coordination complex comprises both the oxidizer and the fuel, is adjusted such that the oxygen balance is between −10.0% and +10.0% $O_2$ by weight of composition as described above. More preferably, the ratio of oxidizer to fuel is adjusted such that the composition oxygen balance is between −4.0% and 1.0% $O_2$ by weight of composition. Most preferably, the ratio is between −2.0% and 0.0% by weight of composition. The oxygen balance is the weight percent of $O_2$ in the composition which is needed or liberated to form the stoichiometrically balanced products. Therefore, a negative oxygen balance represents an oxygen deficient composition whereas a positive oxygen balance represents an oxygen rich composition. It can be appreciated that the relative amounts of oxidizer and fuel will depend on the nature of the selected coordination complex.

In accordance with the present invention, certain coordination complexes of the present invention are self-deflagrating, and therefore, may be the sole constituent of the gas generant compositions. Examples 18, 26, and 27 are particularly illustrative. The combination of high nitrogen, hydrogen, and oxygen in these compounds produces abundant gases and a minimal amount of solids when compared to other known gas generant compositions. Thus, design flexibility is enhanced by the ability to reduce filtration requirements and inflator size. Examples 24 and 25 also illustrate the high alkalinity of combustion solids of known gas generants as compared to those of the present invention utilizing nonmetal coordination complexes and nonazide fuels. As shown, a reduction in the pH of the combustion solids reduces the likelihood of skin and eye irritations to the vehicle occupants.

In certain coordination complexes of the present invention, it may be necessary to include a nonmetal oxidizer or fuel to reduce the amount of nitrogen oxide and carbon monoxide combustion products. In other coordination complexes, the levels of these undesirable gases are below the threshold limits and therefore, the self-deflagrating coordination complexes may be combusted alone.

Another advantage of certain of the gas generants comprised of nonmetallic or nonmetallic/metallic coordination complexes is that the autoignition, or decomposition temperature is reduced below 175° C. Examples 19–21 are illustrative and compare the gas generant compositions of the present invention with other known gas generants. Compositions having autoignition temperatures in this range facilitate the use of lower temperature aluminum or lightweight metal pressure vessels and therefore reduce the weight of the inflator.

In contrast, known metal ammine coordination complex formulations utilize conventional metal fuels such as boron, magnesium, aluminum, silicon, titanium, and zirconium. This results in more solids produced upon combustion, and elevated autoignition temperatures that are not necessarily compatible with lightweight pressure vessels.

The present invention is illustrated by the following examples wherein the components are quantified in weight percent of the total composition unless otherwise stated. Theoretical values of the products are obtained based on the given compositions. Experimental values are given as indicated.

EXAMPLE 1

Ammonium Hexanitrocobaltate (III)/Guanidine Nitrate $$(NH_4)_3[Co(NO_2)_6]+2\ CH_6N_4O_3 \rightarrow CoO+12\ H_2O+2CO_2+17/2\ N_2+1/2\ O_2$$

A mixture of 61.45% $(NH_4)_3[Co(NO_2)_6]$ and 38.55% $CH_6N_4O_3$ is prepared. The components are separately ground to a fine powder by wet tumbling with ceramic cylinders in a ball mill jar. The powder is then separated from the grinding cylinders and granulated to improve the flow characteristics of the material. Next, the ground components are blended in a v-blender prior to compaction. If desired, the homogeneously blended granules may then be cautiously compression molded into pellets by methods known to those skilled in the art. The combustion products include 37.60% $N_2$ (g), 2.53% $O_2$ (g), 13.90% $CO_2$, 34.12% $H_2O$ (v), and 11.85% CoO (s). The total weight percent of gaseous and vapor products is 88.15%. The total gaseous and vapor moles/100 g of gas generant is 3.634.

EXAMPLE 2

Ammonium Hexanitrocobaltate (III)/Diammonium 5,5'-Bitetrazole $$13/8\ (NH_4)_3[Co(NO_2)_6]+(NH_4)_2(CN_4)_2 \rightarrow 13/8\ CoO+55/4\ H_2O+2CO_2+197/16\ N_2+1/16\ O_2$$

A mixture of 78.61% $(NH_4)_3[Co(NO_2)_6]$ and 21.39% $(NH_4)_2(CN_4)_2$ is prepared as in Example 1. The end products include 15.16% CoO (s), 30.78% $H_2O$ (v), 10.94% $CO_2$ (g), 42.87% $N_2$ (g), and 0.25% $O_2$ (g). The total weight percent of gaseous and vapor products is 84.84%. The total gaseous and vapor moles/100 g of gas generant is 3.498.

EXAMPLE 3

Ammonium Hexanitrocobaltate (III)/Diammonium 5,5'-Bitetrazole/Sodium Nitrate $$(NH_4)_3[Co(NO_2)_6]+(NH_4)_2(CN_4)_2+NaNO_3 \rightarrow CoO+5/8\ Na_2O+10\ H_2O+2CO_2+81/8\ N_2+1/16\ O_2$$

A mixture of 58.30% $(NH_4)_3[Co(NO_2)_6]$, 25.78% $(NH_4)_2(CN_4)_2$, and 15.92% $NaNO_3$ is prepared as in Example 1. The end products include 11.24% CoO (s), 5.80% $Na_2O$ (s), 26.98% $H_2O$ (v), 13.19% $CO_2$ (g), 42.49% $N_2$ (g), and 0.30% $O_2$ (g). The total weight percent of gaseous and vapor products is 82.96%. The total gaseous and vapor moles/100 g of gas generant is 3.326.

EXAMPLE 4

Ammonium Hexanitrocobaltate (III)/5-aminotetrazole $$(NH_4)_3[Co(NO_2)_6]+5/4\ CH_3N_5 \rightarrow CoO+63/8\ H_2O+5/4\ CO_2+61/8\ N_2+5/16\ O_2$$

A mixture of 78.55% $(NH_4)_3[Co(NO_2)_6]$ and 21.45% $CH_3N_5$ is prepared as in Example 1. The end products include 15.14% CoO (s), 28.62% $H_2O$ (v), 11.11% $CO_2$ (g), 43.11% $N_2$ (g), and 2.02% $O_2$ (g). The total weight percent of gaseous and vapor products is 84.86%. The total gaseous and vapor moles/100 g of gas generant is 3.446.

EXAMPLE 5

Ammonium Hexanitrocobaltate (III)/Trihydrazino-s-Triazine $$5\ (NH_4)_3[Co(NO_2)_6]+2\ (CH_3N_3)_3 \rightarrow 5\ CoO+39\ H_2O+6\ CO_2+63/2\ N_2+2\ O_2$$

A mixture of 85.05% $(NH_4)_3[Co(NO_2)_6]$ and 14.95% $(CH_3N_3)_3$ is prepared as in Example 1. The end products include 16.39% CoO (s), 30.70% $H_2O$ (v), 11.54% $CO_2$ (g), 38.57% $N_2$ (g), and 2.80% $O_2$ (g). The total weight percent of gaseous and vapor products is 83.61%. The total gaseous and vapor moles/100 g of gas generant is 3.434.

EXAMPLE 6

Ammonium Hexanitrocobaltate (III)/Urazole

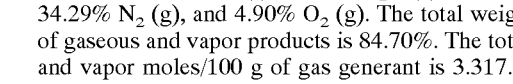

$$(NH_4)_3[Co(NO_2)_6]+C_2H_3N_3O_2 \rightarrow CoO+15/2\ H_2O+2\ CO_2+6\ N_2+3/4\ O_2$$

A mixture of 79.39% $(NH_4)_3[Co(NO_2)_6]$ and 20.61% $C_2H_3N_3O_2$ is prepared as in Example 1. The end products include 15.30% CoO (s), 27.55% $H_2O$ (v), 17.96% $CO_2$ (g), 34.29% $N_2$ (g), and 4.90% $O_2$ (g). The total weight percent of gaseous and vapor products is 84.70%. The total gaseous and vapor moles/100 g of gas generant is 3.317.

EXAMPLE 7

Aminoguanidine Hexanitrocobaltate/Ammonium Hexanitrocobaltate

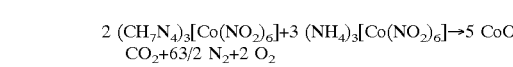

$$2\ (CH_7N_4)_3[Co(NO_2)_6]+3\ (NH_4)_3[Co(NO_2)_6] \rightarrow 5\ CoO+39\ H_2O+6\ CO_2+63/2\ N_2+2\ O_2$$

A mixture of 48.97% $(CH_7N_4)_3[Co(NO_2)_6]$ and 51.03% $(NH_4)_3[Co(NO_2)_6]$ is prepared as in Example 1. The end products include 16.39% CoO (s), 30.70% $H_2O$ (v), 11.54% $CO_2$ (g), 38.57% $N_2$ (g), and 2.80% $O_2$ (g). The total weight percent of gaseous and vapor products is 83.61%. The total gaseous and vapor moles/100 g of gas generant is 3.43.

EXAMPLE 8

Aminoguanidine Hexanitrocobaltate/Ammonium Nitrate

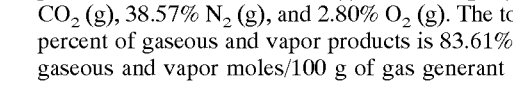

$$(CH_7N_4)_3[Co(NO_2)_6]+6\ NH_4NO_3 \rightarrow CoO+45/2\ H_2O+3\ CO_2+15\ N_2+1/4\ O_2$$

A mixture of 53.85% $(CH_7N_4)_3[Co(NO_2)_6]$ and 46.15% $NH_4NO_3$ is prepared as in Example 1. The end products include 7.21% CoO (s), 38.94% $H_2O$ (v), 12.69% $CO_2$ (g), 40.38% $N_2$ (g), and 0.78% $O_2$ (g). The total weight percent of gaseous and vapor products is 92.79%. The total gaseous and vapor moles/100 g of gas generant is 3.92.

The combustion reactants were prepared by separately grinding the aminoguanidine nitrocobaltate and ammonium nitrate to fine powders. The two components were then combined and blended to form a homogeneous mixture. A small sample of the composition was evaluated for ignitability with a Bernzomatic propane torch. The composition ignited and burned to completion. A rinse of the combustion residue gave a pH reading of 5 to 7. A small sample of the composition was heated on an aluminum block at approximately 15° C./minute. Onset of a gaseous smokey decomposition was observed at 132–134° C. At 160° C., major decomposition with melting, bubbling, and smoke was observed. At 244° C., the remaining product ignited and deflagrated with a flash. A very small quantity of black residue remained.

EXAMPLE 9

Ammonium Hexanitrocobaltate/Aminoguanidine Nitrate

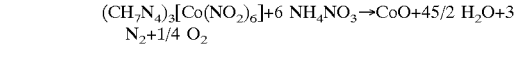

$$(NH_4)_3[Co(NO_2)_6]+2\ CH_7N_5O_3 \rightarrow CoO+13\ H_2O+2\ CO_2+9.5\ N_2$$

A mixture of 58.67% $(NH_4)_3[Co(NO_2)_6]$ and 41.33% $CH_7N_5O_3$ is prepared as in Example 1. The end products include 11.31% CoO (s), 35.29% $H_2O$ (v), 13.27% $CO_2$ (g), and 40.12% $N_2$ (g). The total weight percent of gaseous and vapor products is 88.68%. The total gaseous and vapor moles/100 g of gas generant is 3.70.

EXAMPLE 10

Ammonium Hexanitrocobaltate/Ammonium Nitrate/5-aminotetrazole

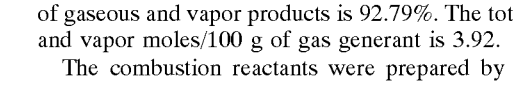

$$(NH_4)_3[Co(NO_2)_6]+6\ NH_4NO_3+3\ CH_3N_5 \rightarrow CoO+45/2\ H_2O+3\ CO_2+18\ N_2+1/4\ O_2$$

A mixture of 34.61% $(NH_4)_3[Co(NO_2)_6]$, 42.70% $NH_4NO_3$, and 22.69% $CH_3N_5$ is prepared as in Example 1. The end products include 6.67% CoO (s), 36.03% $H_2O$ (v), 11.74% $CO_2$ (g), 44.84% $N_2$ (g), and 0.72% $O_2$ (g). The total weight percent of gaseous and vapor products is 93.33%. The total gaseous and vapor moles/100 g of gas generant is 3.90.

EXAMPLE 11

Ammonium Hexanitrocobaltate/Ammonium Nitrate

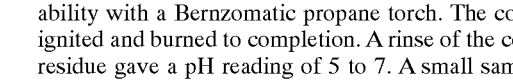

$$(NH_4)_3[Co(NO_2)_6]+NH_4NO_3 \rightarrow CoO+8\ H_2O+11/2\ N_2+3\ O_2$$

A mixture of 82.94% $(NH_4)_3[Co(NO_2)_6]$ and 17.06% $NH_4NO_3$ is prepared as in Example 1. The end products include 15.99% CoO (s), 30.70% $H_2O$ (v), 32.84% $N_2$ (g), and 20.47% $O_2$ (g). The total weight percent of gaseous and vapor products is 84.01%. The total gaseous and vapor moles/100 g of gas generant is 3.52.

EXAMPLE 12

Hydrazine Sodium Hexanitrocobaltate/5-aminotetrazole

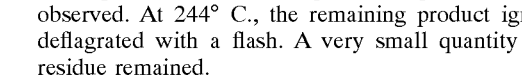

$$2\ N_2H_6Na[Co(NO_2)_6]+4\ CH_3N_5 \rightarrow Na_2CO_3+2\ CoO+12\ H_2O+3\ CO_2+18\ N_2+1/2\ O_2$$

A mixture of 69.75% $N_2H_6Na[Co(NO_2)_6]$ and 30.25% $CH_3N_5$ is prepared as in Example 1. The end products include 13.35% CoO (s), 9.43% $Na_2CO_3$ (s), 19.22% $H_2O$ (v), 11.74% $CO_2$ (g), 44.84% $N_2$ (g), and 1.42% $O_2$ (g). The total weight percent of gaseous and vapor products is 77.22%. The total gaseous and vapor moles/100 g of gas generant is 2.980.

EXAMPLE 13

Hydrazine Sodium Hexanitrocobaltate/Guanidine Nitrate

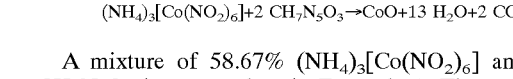

$$N_2H_6Na[Co(NO_2)_6]+3\ CH_6N_4O_3 \rightarrow 1/2\ Na_2CO_3+CoO+12\ H_2O+5/2\ CO_2+10\ N_2+3/4\ O_2$$

A mixture of 51.72% $N_2H_6Na[Co(NO_2)_6]$ and 48.28% $CH_6N_4O_3$ is prepared as in Example 1. The end products include 14.51% CoO (s), 6.99% $Na_2CO_3$ (s), 28.50% $H_2O$ (v), 14.51% $CO_2$ (g), 36.94% $N_2$ (g), and 3.17% $O_2$ (g). The total weight percent of gaseous and vapor products is 83.12%. The total gaseous and vapor moles/100 g of gas generant is 3.331.

EXAMPLE 14

Ammonium Nitrocobaltate

In accordance with the present invention, this example describes the preparation of ammonium hexanitrocobaltate or ammonium cobaltinitrite as it is sometimes called, and its associated reaction products. Ammonium hexanitrocobaltate may be prepared by several different methods. Two different methods will be discussed in this example.

(a) From ammonium nitrite solution:

Ammonium cobaltinitrite was prepared by heating a mixture of a solution of cobaltous chloride hexahydrate and a solution of 18% ammonium nitrite, acidified with 6 molar acetic acid. A mustard colored precipitate formed and settled on the bottom of the reaction vessel.

(b) From sodium cobaltinitrite solution:

Ammonium cobaltinitrite was prepared by mixing a solution of sodium cobaltinitrite, acidified to a pH of 2–6 by the dropwise addition of 6 molar acetic acid, with a solution of ammonium chloride. A cloudy precipitate appeared on mixing of the two solutions and on evaporation resulted in formation of a mustard colored crystalline material.

In another preparation, seven grams of sodium cobaltinitrite were dissolved in 150 mls. of distilled water at ambient temperature. When the sodium cobaltinitrite solution was poured into a solution prepared by dissolving four grams of ammonium chloride in 100 mls. of distilled water, a precipitate formed. The reaction mixture containing the precipitate was gravity filtered, washed with distilled water, further washed with alcohol, and vacuum dried over phosphorus pentoxide at ambient temperature. The vacuum dried product had the consistency of a very fine powder, exhibited low solubility, and had a golden (poppy) color. A small quantity of the reaction material was placed in a test tube and covered with distilled water containing several drops of 6 molar sodium hydroxide solution. The mouth of the test tube was covered with a piece of wetted Hydrion pH test paper and heated carefully to prevent spattering of the liquid contents onto the test paper. After a short period of heating, the pH test paper turned a uniform color indicative of an alkaline pH and formation of gaseous ammonia. With continued heating, a strong odor of ammonia evolved from the mouth of the test tube and the liquid turned blue. A sample of the material was heated in a glass tube closed at one end in a sand bath, and decomposed without melting (cooked off—no explosion) with rapid gaseous decomposition at about 232 to 242° C. dependent on sample size and heating rate. The temperature at which major decomposition occurred was dependent on sample size and heating rate. A very small quantity of black residue remained.

In yet another preparation, 14.0 grams of sodium cobaltinitrite dissolved in 300 mls of distilled water were reacted with a solution of 8.0 grams of ammonium chloride dissolved in 200 mls of distilled water acidified with 6 molar acetic acid. The precipitate was allowed to settle overnight, vacuum filtered, washed with water followed by alcohol, and dried under vacuum over phosphorus pentoxide. After drying, the resulting material was a fine powder with a golden poppy/pumpkin color and exhibited very low solubility in water and alcohol.

EXAMPLE 15

Hydrazine Sodium Nitrocobaltate

In accordance with the present invention, this example describes the preparation of hydrazine sodium hexanitrocobaltate, or sodium hydrazine cobaltinitrite, and the associated reaction products.

Hydrazine sodium hexanitrocobaltate along with associated reaction products is prepared as follows: 15 grams of hydrazine sulfate, 10 grams of sodium acetate, and 5 grams of sodium bicarbonate were dissolved in 100 mls. of water, cooled to 0° C., thereby forming a sodium sulfate precipitate that was promptly removed. Sodium cobaltinitrite was then added to the solution in dropwise fashion; the solution was then cooled to 0° C. A yellow precipitate formed which was then filtered, washed with cold and weakly acidic water, then alcohol, then ether, and finally dried in a vacuum.

EXAMPLE 16

Methylamine Nitrocobaltate

In accordance with the present invention, this example describes the preparation of methylamine cobaltinitrite and associated reaction products formed when solutions of sodium cobaltinitrite and methylamine hydrochloride are combined.

To a nearly saturated solution of methylamine hydrochloride is added a nearly saturated solution of sodium cobaltinitrite. Almost immediately a deep yellow, crystalline precipitate is produced. After stirring for three or four minutes, it is vacuum filtered and rapidly washed with a very small quantity of ice-cold water followed with 50% alcohol. The material is then further dried over phosphorus pentoxide in an evacuated desiccator.

EXAMPLE 17

Aminoguanidine Nitrocobaltate

In accordance with the present invention, this example describes the preparation of the reaction products formed when solutions of aminoguanidine nitrate or aminoguanidine bicarbonate, and sodium cobaltinitrite are combined. Analogous reaction products, such as nitrometallates formed from diaminoguanidine and triaminoguanidine, and metal/aminoguanidine analogs may be prepared in the same manner.

(a) From aminoguanidine nitrate solution, with acidification:

Concentrated solutions of aminoguanidine nitrate (Fisher Scientific-ACROS) and sodium cobaltinitrite (Fisher Scientific-ACROS) were prepared by dissolving each compound in distilled water at an elevated temperature (below boiling), which was acidified with 6 molar acetic acid to a pH of 2–6.9. The two separate solutions were then mixed together while hot. The reaction vessel was then placed under a cold water tap to cool the contents. Formation of a tan colored cloudy precipitate with an orange cast resulted. The contents of the reaction vessel were vacuum filtered, washed with distilled water, and redispersed in distilled water. The product appeared to have negligible solubility when redispersed and the pH was determined to be about 3 to 5 when tested with Hydrion test paper.

The dispersion was centrifuged to separate the solid from the liquid phase. A small portion of the solid material was dried under ambient conditions. When heated on an aluminum block at 10 to 20 degrees per minute, the edges of the material began to turn brown in color progressing to a uniform dark brown color through out the mass over a temperature range of 101 to 293° C. The material autoignited and cooked off with a flash at about 293° C. A very small portion of a black residue remained.

(b) From aminoguanidine nitrate solution, without acidification:

A predetermined excess of aminoguanidine nitrate (Fisher Scientific-ACROS), and a predetermined amount of sodium cobaltinitrite (Fisher Scientific-ACROS) were solubilized together in distilled water. Controlled heating (below boiling) of the solution was conducted to promote effervescence of the solution, but to prevent overflowing from the reaction vessel. Once the effervescence subsided and the reaction terminated, the solution was cooled to form a precipitate.

(c) From aminoguanidine bicarbonate solution:

A difficultly soluble saturated solution of aminoguanidine bicarbonate (Fisher Scientific-ACROS) was prepared as in method 17(a), and mixed with a concentrated solution of sodium cobaltinitrite (Fisher Scientific-ACROS), acidified to a pH of 2–6.9 by dropwise addition of 6 molar acetic acid. On mixing the solutions together a brownish color appeared. The reaction mixture was slowly heated nearly to boiling resulting in effervescence. Once effervescence ceased, the reaction vessel containing the hot mixture was then placed in a mixture of ice and water and stored in a refrigerator overnight. The next morning it was observed that a cocoa brown solid layer had settled below the darker brown liquid layer of the reaction vessel. The contents of the reaction vessel were gravity filtered and dried at ambient temperature and pressure. When this product and a sample from method (a) were simultaneously heated on an aluminum block at 10° C./minute, both flashed off at 300° C. A very small portion of a black residue remained.

Other manufacturers of the reactants herein include Aldrich, GFS, Baker, and P&B. Although bicarbonate is used in this example, carbonates of the desired guanidine derivative, diaminoguanidine or triaminoguanidine for example, may also be used.

EXAMPLE 18

Hydrazine Nitrocobaltate

In accordance with the present invention, this example describes the preparation of hydrazine nitrocobaltate and associated reaction products formed by the addition of a highly alkaline hydrazine derivative, hydrazine hydrate (Olin, Fisher Scientific-ACROS) (85% $N_2H_4$—$H_2O$), to a slightly acidified solution of sodium cobaltinitrite at ambient temperature. Analogous reaction products, formed from other hydrazine derivatives and nonmetal cations described herein, may be prepared in the same manner.

Hydrazine hydrate (pH>12) was added very slowly, drop by drop, to a solution of sodium cobaltinitrite acidified to a pH of 2–5 with 6 molar acetic acid. As each drop of hydrazine hydrate was added, an effervescent formation of a brown colored cloudy precipitate occurred, followed by formation of a dark purple/black precipitate and a wine-colored liquid layer. Dropwise addition continued until all effervescence terminated. On settling, the solution was gravity filtered, washed with distilled water and followed with an alcohol wash. The material was then allowed to air dry at ambient temperature. After drying for several days at room temperature, the reaction material can be described as a fine powder with a dark purple/black color. When a small quantity of the dry material is heated on a stainless steel spatula over a bunsen burner flame, it deflagrates with very little delay, very rapidly like flash powder or very fine black powder.

On heating in distilled water, the material dissolves, without any detectable odor. On addition of 6 molar sodium hydroxide to a heated aqueous solution of the reaction product, a strong odor of ammonia is given off, and the solution turns a light blue color forming a blue precipitate as it cools.

EXAMPLE 19

Oxidizer Decomposition Temperatures

This example illustrates the difference between the temperature of major decomposition for nitrometallates with alkali metal cations, and that of nitrometallates with nonmetal cations. The following three compounds were heated for the same time and rate on an aluminum block, but separated some distance from each other.

| Compound | Temperature of Major Decomposition, ° C. (° F.) (Heated at Ambient Pressure on an Aluminum Block at approx. 15° C./min.) |
|---|---|
| (1) Sodium cobaltinitrite | 260 (510) |
| (2) Potassium cobaltinitrite | 254 (490) |
| (3) Ammonium cobaltinitrite | 204 (400) |
| (4) Reaction product of sodium cobaltinitrite and aminoguanidine nitrate | 293 (560) |

EXAMPLE 20

Oxidizer Decomposition Temperatures

Major decomposition occurred earlier and was much more rapid for the hexanitrocobaltate with the ammonium cation than with hexanitrocobaltates with metal cations when dropped on the heated aluminum block.

| Compound | Temperature of Major Decomposition, ° C. (° F.) (Dropped on a Heated Aluminum Block) |
|---|---|
| (1) Sodium cobaltinitrite | 160(320) NMD; 215(420) NMD; 240(464) GD |
| (2) Potassium cobaltinitrite | 160(320) NMD; 215(420) NMD; 240(464) GD |
| (3) Ammonium cobaltinitrite | 160(320) GD; 215(420) MGD; 240(464) MGD |

NMD = No major decomposition
GD = Gaseous decomposition
MGD = Major Gaseous Decomposition NMD=No major decomposition
GD=Gaseous decomposition
MGD=Major Gaseous Decomposition

EXAMPLE 21

Thermal Decomposition of Oxidizers with Fuels

The following examples illustrate the difference in temperature of decomposition between (a) mixtures of nonmetal oxidizers of the present invention with fuels, and (b) mixtures of known alkali metal oxidizers with fuels. In each case the mixtures are formulated stoichiometrically to provide substantially nitrogen, carbon dioxide, and water vapor as gaseous decomposition products.

| Combination | Temperature of Major Decomposition, ° C. (° F.) Heating Rate approx. 10° C./minute at Ambient Pressure |
|---|---|
| (1) Ammonium Cobaltinitrite/5-Aminotetrazole | 160(320) Dec |
| (2) Potassium Cobaltinitrite/5-Aminotetrazole | 193(380) Ign |
| (3) Ammonium Cobaltinitrite/Ammonium 5,5'-Bitetrazole | 160(320) Dec |
| (4) Ammonium Cobaltinitrite/Guanidine Nitrate | 160(320) Dec* |
| (5) Potassium Cobaltinitrite/Guanidine Nitrate | 215(420) Ign |

*Decomposition observed at 160(320) with cookoff/flash at 232(450).

*Decomposition observed at 160(320) with cookoff/flash at 232(450).

EXAMPLE 22

Ignitability of Oxidizer/Fuel Mixtures (fuse test)

The following example illustrates the difference in ignitability, using a 3/32" fuse, between (a) mixtures of nonmetal oxidizers claimed in the present invention with fuels, and (b) mixtures of alkali metal oxidizers of prior art with fuels. In all cases the mixtures are formulated stoichiometrically to form substantially gaseous decomposition products of nitrogen, carbon dioxide, and water vapor.

| Combination | Ignition and Self-sustained Combustion at Ambient Pressure |
|---|---|
| (1) Ammonium Cobaltinitrite/5-Aminotetrazole | Yes |
| (2) Potassium Cobaltinitrite/5-Aminotetrazole | Marginal |
| (3) Ammonium Cobaltinitrite/Ammonium 5,5'-Bitetrazole | Marginal |
| (4) Potassium Cobaltinitrite/Ammonium 5,5-Bitetrazole | No |
| (5) Ammonium Cobaltinitrite/Guanidine Nitrate | Yes |
| (6) Potassium Cobaltinitrite/Guanidine Nitrate | No |

EXAMPLE 23

Ignitability of Oxidizer/Fuel Mixtures (torch test)

The following example illustrates the difference in ignitability using a Bernzomatic propane torch between (a) mixtures of nonmetal oxidizers of the present invention with fuels, and (b) mixtures of known alkali metal oxidizers with fuels. In all cases the mixtures are formulated stoichiometrically to form substantially gaseous decomposition products of nitrogen, carbon dioxide, and water vapor.

| Combination | Self-sustained Combustion at Ambient Pressure |
|---|---|
| (1) Ammonium Cobaltinitrite/5-Aminotetrazole | Yes |
| (2) Potassium Cobaltinitrite/5-Aminotetrazole | Yes |
| (3) Ammonium Cobaltinitrite/Ammonium 5,5'-Bitetrazole | Yes |
| (4) Potassium Cobaltinitrite/Ammonium 5,5-Bitetrazole | No |
| (5) Ammonium Cobaltinitrite/Guanidine Nitrate (GN) | Yes |
| (6) Potassium Cobaltinitrite/GN | No |
| (7) Ammonium Cobaltinitrite/GN/Ammonium 5,5-Bitetrazole | Yes |

EXAMPLE 24 pH of Oxidizer/Fuel Mixture Decomposition Products

The following example illustrates the difference in alkalinity between (a) mixtures of nonmetal oxidizers claimed in the present invention with fuels and (b) mixtures of known alkali metal oxidizers with fuels. In all cases the mixtures are formulated stoichiometrically to form substantially gaseous decomposition products of nitrogen, carbon dioxide, and water vapor.

| Combination | pH of Solid Decomp. Products |
|---|---|
| (1) Ammonium Cobaltinitrite/5-Aminotetrazole | 6–7 |
| (2) Potassium Cobaltinitrite/5-Aminotetrazole | 11–12 |
| (3) Ammonium Cobaltinitrite/Ammonium 5,5'-Bitetrazole | 6–7 |
| (4) Potassium Cobaltinitrite/Ammonium 5,5-Bitetrazole | 11–12 |
| (5) Ammonium cobaltinitrite/Guanidine Nitrate (GN) | 6–7 |
| (6) Potassium Cobaltinitrite/GN | 11–12 |
| (7) Ammonium Cobaltinitrite/GN/Ammonium 5,5-Bitetrazole | 6–7 |

In accordance with the present invention, the use of nonmetal polynitrometallate oxidizers reduces solid particulates and results in reaction products which are not caustic and are substantially innocuous. As shown, the use of known alkali cationic oxidizers results in extremely caustic decomposition products that could cause severe burns of the eyes and skin, in the event of vehicle occupant exposure.

EXAMPLE 25

Ammonium Cobaltinitrite and Ammonium Nitrate

In accordance with the present invention, this example describes the combustion characteristics of a mixture with ammonium nitrate formulated to provide nitrogen, oxygen, and water vapor as gaseous decomposition products. A mixture of 82.94% ammonium cobaltinitrite and 17.06% ammonium nitrate was prepared and evaluated to determine if ignition followed by sustained combustion would result when tested at ambient temperature an pressure. The mixture was ignited with a fuse and maintained self-sustained gaseous decomposition with little or no flame until depleted. A rinse of the solid black residual reaction product gave a pH value of 8–9.

EXAMPLE 26

Self Deflagration of the Reaction Product of Aminoguanidine Nitrate and Sodium Cobaltinitrite In accordance with the present invention a small portion of the aminoguanidine nitrocobaltate reaction product, formed from the reaction of solutions of sodium cobaltinitrite and aminoguanidine nitrate was placed in the center of a piece of filter paper and ignited on the edge. When the flame reached the reaction product at the center of the filter paper, the material self deflagrated with a flash at ambient pressure. In another test, a small portion of the material was placed in the center of a watchglass and ignited with a "Bernzomatic" propane torch. Again, the material self deflagrated with a flash at ambient pressure. The pH of a rinse of the combustion product in the watchglass was determined to be about 5 to 7, or essentially neutral.

Two known metal nitrometallates of U.S. Pat. No. 5,160,386, each consisting of an alkali metal cation polynitritometallate (III) oxidizer, were subjected to the same tests. Neither potassium hexanitritocobaltate (III) nor sodium hexanitritocobaltate (III) self deflagrated.

EXAMPLE 27

Self Deflagration of Reaction Product of Hydrazine Hydrate and Sodium Cobaltinitrite In accordance with the present invention a small portion of the hydrazine nitrocobaltate derivative formed from the reaction of solutions of sodium cobaltinitrite and hydrazine hydrate was placed on an aluminum block and heated at approximately 15° C. per minute. At a temperature of 127° C. (260° F.) the material deflagrated. In another test, a very small portion of the reaction product was placed in the center of a piece of filter paper and ignited on the edge. When the flame reached the reaction product at the center of the filter paper, the material self deflagrated with a flash at ambient pressure. In another test, a small portion of the material was placed in the center of a watch glass and touched with the flame of a "Bernzomatic" propane torch. Again, the material self deflagrated with a flash at ambient pressure. The pH of a rinse of a combustion product in the watch glass was determined to be about 5 to 7, or essentially neutral.

Two known metal nitrometallates of U.S. Pat. No. 5,160,386, each consisting of an alkali metal cation polynitrito-metallate (III) oxidizer, were subjected to the same tests. Neither potassium hexanitritocobaltate (III) nor sodium hexanitritocobaltate (III) self deflagrated.

While the foregoing examples illustrate and describe the use of the present invention, they are not intended to limit the invention as disclosed in certain preferred embodiments herein. Therefore, variations and modifications commensurate with the above teachings and the skill and/or knowledge of the relevant art, are within the scope of the present invention.

We claim:

1. A gas generant composition, hydrated or anhydrous, comprising a first nitrogen-containing fuel and/or a first oxidizer, and at least one coordination complex, said coordination complex represented by the formula:

$$(NM)_u(M')_x[M''_y(NO_2)_z]$$

wherein:

(NM) is a nonmetal cation selected from the group consisting of ammonium, hydrazinium, guanidinium, aminoguanidinium, polyaminoguanidinium, hydroxylaminium, and aromatic and aliphatic amine cations;

M' is an alkali metal or an alkaline earth metal;

M" is a coordination metal selected from the transition metals of Groups 4–12 of the Periodic Table;

u=1,2,3, or 4;

x=0,1,2, or 3;

y=1,2, or 3; and z=4 or 6 nitrito/nitro groups as determined by the required stoichiometry of the nonmetal NM and the metal M'.

2. A gas generant composition, hydrated or anhydrous, comprising a first nitrogen-containing fuel and/or a first oxidizer, and at least one coordination complex, said coordination complex represented by the formula:

$$(NM)_u(M')_x[M''_y(NO_2)_z]$$

wherein:

(NM) is a nonmetal cation selected from the group consisting of ammonia, hydrazine, hydroxylamine, guanidine, aminoguanidine, diaminoguanidine, triaminoguanidine, biguanidine, aminotriazole, guanizine, aminotetrazole, hydrazino tetrazole, 5-guanylaminotetrazole, diaminofurazan, diaminotriazole, and azoamino bis(aminofurazan) derivatives;

M' is an alkali metal or an alkaline earth metal;

M" is a coordination metal selected from the transition metals of Groups 4–12 of the Periodic Table;

u=1,2,3, or 4;

x=0,1,2, or 3;

y=1,2, or 3; and z=4 or 6 nitrito/nitro groups as determined by the required stoichiometry of the nonmetal NM and the metal M'.

3. A gas generant composition, hydrated or anhydrous, comprising a first nitrogen-containing fuel and/or a first oxidizer, and at least one coordination complex selected from the group consisting of ammonium hexanitrocobaltate (III), hydrazine nitrocobaltate, aminoguanidine nitrocobaltate, methylamine nitrocobaltate, sodium ammonium nitrocobaltate, sodium hydrazine nitrocobaltate, diaminoguanidine nitrocobaltate, and triaminoguanidine nitrocobaltate.

4. A gas generant composition comprising a first nitrogen containing fuel and/or a first oxidizer and the solid reaction products of sodium cobaltinitrite and a soluble nonmetal compound selected from the group consisting of guanidine, aminoguanidine, diaminoguanidine, triaminoguanidine, hydrazine, and hydroxylamine derivatives and compounds.

5. The composition of claim 2 wherein said first nitrogen-containing fuel is employed in a concentration of 0.1–70% by weight of the total composition.

6. The composition of claim 2 wherein said first nitrogen-containing fuel is selected from the group consisting of oxamide, oxalyldihydrazide, azoles, bitetrazoles, tetrazoles, triazoles, and triazines; nonmetal and metal derivatives of bitetrazoles, tetrazoles, triazoles, and triazines; and derivatives of guanidine, hydrazine, hydroxylamine, and ammonia.

7. The composition of claim 6 wherein said first nitrogen-containing fuel is selected from the group consisting of guanidine nitrate, aminoguanidine nitrate, diaminoguanidine nitrate, triaminoguanidine nitrate (wetted or unwetted), guanidine perchlorate (wetted or unwetted), triaminoguanidine perchlorate (wetted or unwetted), guanidine picrate (wetted or unwetted), triaminoguanidine picrate (wetted or unwetted), nitroguanidine (wetted or unwetted), nitroaminoguanidine (wetted or unwetted), metal salts of nitroaminoguanidine, metal salts of nitroguanidine, nitroguanidine nitrate, nitroguanidine perchlorate, and mixtures thereof.

8. The composition of claim 6 wherein said first nitrogen-containing fuel is selected from the group consisting of urazole, aminourazole, tetrazole, azotetrazole, 1H-tetrazole, 5-aminotetrazole, 5-nitrotetrazole, 5-nitroaminotetrazole, manganese 5,5'-bitetrazole, 5,5'-bitetrazole, azobitetrazole, diguanidinium-5,5'-azotetrazolate, diammonium 5,5'-bitetrazole, metal and nonmetal salts of said tetrazoles, and mixtures thereof.

9. The composition of claim 6 wherein said first nitrogen-containing fuel is selected from the group consisting of 2,4,6-trihydrazino-s-triazine, 2,4,6-triamino-s-triazine, melamine nitrate, triazole, nitrotriazole, nitroaminotriazole, 3-nitro-1,2,4-triazole-5-one, metallic and nonmetallic salts of said triazoles and triazines, and mixtures thereof.

10. The composition of claim 2 comprising said at least one coordination complex, and, said first nitrogen-containing fuel selected from the group consisting of azides of potassium, sodium, lithium, and strontium, and, azido pentammine cobalt (III) nitrate.

11. The composition of claim 2 comprising said at least one coordination complex and said first oxidizer, wherein said first oxidizer is selected from the group consisting of alkali metal, alkaline earth metal, transitional metal and nonmetallic nitrates, nitrites, perchlorates, chlorates, chlorites, chromates, oxalates, halides, sulfates, sulfides, persulfates, peroxides, oxides, and, nitramides, cyclic nitramines, linear nitramines, caged nitramines, and mixtures thereof.

12. The composition of claim 11 wherein said first oxidizer is employed in a concentration of 0.1–50% by weight of the total composition.

13. The composition of claim 11 wherein said first oxidizer is selected from the group consisting of phase stabilized ammonium nitrate, ammonium nitrate, ammonium perchlorate, sodium nitrate, potassium nitrate, strontium nitrate, copper oxide, molybdenum disulfide, nitroguanidine, ammonium dinitramide, cyclotrimethylene trinitramine, cyclotetramethylene tetranitramine, and mixtures thereof.

14. The composition of claim 4 wherein said soluble nonmetal compounds are selected from the group consisting of aminoguanidine nitrate and hydrazine hydrate.

15. The composition of claim 2 comprising a mixture of ammonium hexanitrocobaltate (III), ammonium nitrate, and 5-aminotetrazole.

16. The composition of claim 2 further comprising at least one metal coordination complex selected from the group consisting of metal ammine coordination complexes, metal hydrazine coordination complexes, and metal polynitrito metallate coordination complexes.

17. The composition of claim 16 wherein said at least one metal coordination complex is a metal ammine coordination complex selected from the group consisting of hexamminechromium (III) nitrate, trinitrotriamminecobalt (III), hexammine cobalt (III) nitrate, hexammine cobalt (III) perchlorate, hexammine nickel (II) nitrate, tetramminecopper (II) nitrate, cobalt (III) dinitratobis(ethylenediamine) nitrate, cobalt (III) dinitrobis(ethylenediamine) nitrate, cobalt (III) dinitrobis(ethylenediamine) nitrite, and cobalt (III) hexahydroxylammine nitrate.

18. The composition of claim 16 wherein said at least one metal coordination complex is a metal hydrazine coordination complex selected from the group consisting of sodium hydrazine hexanitrocobaltate, zinc nitrate hydrazine, tris-hydrazine zinc nitrate, bis-hydrazine magnesium perchlorate; bis-hydrazine magnesium nitrate; and bis-hydrazine platinum (II) nitrite.

19. The composition of claim 16 wherein said at least one metal coordination complex is a metal polynitrito metallate coordination complex selected from the group consisting of potassium hexanitrocobaltate and sodium hexanitrocobaltate.

20. The composition of claim 2 further comprising a ballistic modifier selected from the group consisting of metallocenes and chelates of metals, and metal chromium salts, the metal being selected from Groups 1–14 of the Periodic Table of Elements; elemental sulfur; or mixtures thereof, employed in a concentration of 0.1 to 25% by weight of the total gas generant.

21. The composition of claim 2 further comprising an inert slag former and coolant selected from the group consisting of lime, borosilicates, vycor glasses, bentonite clay, silica, alumina, silicates, aluminates, and mixtures thereof, employed in a concentration of 0.1 to 10% by weight of the total gas generant composition.

22. The composition of claim 2 comprising a mixture of ammonium hexanitrocobaltate (III), diammonium 5,5'-bitetrazole, guanidine nitrate, and sodium nitrate.

23. The composition of claim 2 further comprising an ignition aid selected from the group consisting of boron, carbon black, magnesium, aluminum, titanium, zirconium, hafnium, transition metal hydrides, and mixtures thereof, employed in a concentration of 0.1 to 20% by weight of the gas generant.

24. The composition of claim 2 further comprising a processing aid selected from the group consisting of; graphite; boron nitride; alkali, alkaline earth, and transition metal stearates; polyethylene glycols; polypropylene carbonates; lactose; polyacetals; polyvinyl acetates; polycarbonates; polyvinyls; alcohols; fluoropolymers; paraffins; silicone waxes; and mixtures thereof, employed in a concentration of 0.1 to 15% by weight of the gas generant.

25. The composition of claim 2 further comprising an inert combination slag former and coolant selected from the group consisting of clay, diatomaceous earth, alumina, silica, and mixtures thereof, wherein said slag former is employed in a concentration of 0.1 to 10% by weight of the gas generant composition.

26. The composition of claim 2 comprising aminoguanidine nitrocobaltate and ammonium nitrocobaltate.

27. A gas generant composition comprising a first nitrogen-containing fuel and/or a first oxidizer, and the reaction products of sodium cobaltinitrite and a soluble nonmetal compound selected from the group consisting of guanidine, aminoguanidine, diaminoguanidine, triaminoguanidine, hydrazine, and hydroxylamine compounds.

28. The composition of claim 27 wherein said soluble nonmetal compounds are selected from the group consisting of aminoguanidine nitrate and hydrazine hydrate.

29. The composition of claim 7 comprising a mixture of ammonium hexanitrocobaltate (III) and aminoguanidine nitrate.

30. The composition of claim 7 comprising a mixture of ammonium hexanitrocobaltate (III) and guanidine nitrate.

31. The composition of claim 8 comprising a mixture of ammonium hexanitrocobaltate (III) and urazole.

32. The composition of claim 8 comprising a mixture of ammonium hexanitrocobaltate (III) and diammonium 5,5'-bitetrazole.

33. The composition of claim 8 comprising a mixture of ammonium hexanitrocobaltate (III) and 5-aminotetrazole.

34. The composition of claim 9 comprising a mixture of ammonium hexanitrocobaltate (III) and trihydrazino-s-triazine.

35. The composition of claim 13 comprising a mixture of ammonium hexanitrocobaltate (III) and ammonium nitrate.

* * * * *